US006066029A

United States Patent [19]

Kondo

[11] Patent Number: 6,066,029

[45] Date of Patent: May 23, 2000

[54] METHOD OF FLATTENING SURFACES OF SHEET MATERIAL, AND METHOD OF MANUFACTURING SHEET MATERIAL ON THE BASIS OF SAME

[75] Inventor: Hirofumi Kondo, Sodegaura, Japan

[73] Assignee: Idemitsu Kosan CO., LTD., Tokyo, Japan

[21] Appl. No.: 09/077,375

[22] PCT Filed: Dec. 4, 1996

[86] PCT No.: PCT/JP96/03544

§ 371 Date: Sep. 28, 1998

§ 102(e) Date: Sep. 28, 1998

[87] PCT Pub. No.: WO97/20658

PCT Pub. Date: Jun. 12, 1997

[30] Foreign Application Priority Data

Dec. 6, 1995 [JP] Japan ..... 7-318415

[51] Int. Cl.[7] ..... B24B 1/00

[52] U.S. Cl. ..... 451/41; 451/56

[58] Field of Search ..... 451/28, 41, 56

[56] References Cited

U.S. PATENT DOCUMENTS

| | | | |
|---|---|---|---|
| Re. 35,666 | 11/1997 | Smith | 125/13.01 |
| 3,780,626 | 12/1973 | Hollier, Jr. | 451/182 |
| 3,845,533 | 11/1974 | Tinfow et al. | 29/90.01 |
| 4,645,484 | 2/1987 | Niske | 493/362 |
| 5,036,629 | 8/1991 | Ishikuro et al. | 451/57 |
| 5,331,773 | 7/1994 | Biancalani et al. | 451/28 |
| 5,335,456 | 8/1994 | Mishima | 451/28 |

*Primary Examiner*—Timothy V. Eley

*Attorney, Agent, or Firm*—Antonelli, Terry, Stout & Kraus, LLP

[57] ABSTRACT

A method of flattening projections on a sheet material having fine projections on a surface thereof, which protrude from a flat portion of the sheet material, said method comprising partially immersing a rod member, which has a surface having a polishing capability, into a liquid, rotating the rod member so as to form a film of the liquid on the surface of the portion of the rod member, which is exposed above the surface of the liquid, and conveying the sheet material in one direction while contacting a surface of the sheet material with the film, thus polishing the projections.

28 Claims, 1 Drawing Sheet

METHOD OF FLATTENING SURFACES OF SHEET MATERIAL, AND METHOD OF MANUFACTURING SHEET MATERIAL ON THE BASIS OF SAME

TECHNICAL FIELD

The present invention relates to a method of flattening the projections on the surfaces of plastic films or glass plates to be used as the panel substrates of liquid crystal display devices or the like, or on films formed on the surfaces by coating or lamination. The method of the present invention is particularly suited to polish the substrates for liquid crystal display devices useful for the production of large-area and mass-storage dot matrix liquid crystal display devices so that the substrates have highly flattened surfaces.

The present invention also relates to a liquid crystal device having a substrate made of a sheet material which has a surface flattened by polishing projections by the method of the present invention.

BACKGROUND ART

Plastic films and glass plates have fine projections on their surfaces, and when these are used as the panel substrates of liquid crystal devices, the projections hinder the uniformity of the gap between the panel substrates, causing display defects. For example, plastic films generally have projections of several $\mu$m to over ten $\mu$m in height on their surfaces. When the plastic films having such projections are used in TN (twisted nematic) cells or STN (super-twisted nematic) cells wherein liquid crystals are interposed between substrates arranged generally with a space of 6 to 10 $\mu$m, the projections higher than the space cause considerable display defects.

Particularly, liquid crystal display devices using ferroelectric liquid crystals need substrates arranged with a space of about 2 $\mu$m, and it is very difficult to produce liquid crystal display devices free from display defects by using such plastic film substrates or glass substrates.

When the electrode layers of electroded substrates are coated with an insulating film or the like, foreign matter or gel in the insulating layer tends to form projections on its surface so as to deteriorate the surface flatness. So when liquid crystals are sealed between the substrates arranged with a space of several microns, the projections also cause considerable display defects.

Japanese Patent Application Unexamined Publication No. 6-758 discloses a polishing apparatus for flattening the surfaces of the filter substrates of liquid crystal panels, by conveying an abrasive tape in one direction along the surfaces of rolls to give a pressing-polishing area, where a filter substrate is pressed to the abrasive tape at a uniform pressure while being put into reciprocating motion to polish the contacting portion. However, when polishing is carried out under a uniform pressure, the degree of polishing varies depending on not only the heights of the projections but also the forms thereof, and the heights of the polished projections cannot be adjusted accurately. Further, the pressure applied to the surface of the substrate makes the abrasive tape contact even the flat portions, so that when the substrate bears patterned transparent electrodes, the electrodes tend to be cut.

Japanese Patent Application Unexamined Publication No. 4-31030 discloses a method of producing heat resistant optical films having high surface flatness and good appearance by rotating an amorphous thermoplastic resin film of a glass transition temperature of 180° C. or more under an applied pressure on an abrasive cloth fixed onto a stationary platform, with an abrasive liquid fed therebetween. The degree of polishing made by this method, however, also depends on the heights and forms of projections, and the heights of the polished projections cannot be adjusted accurately. Further, when substrates bearing patterned transparent electrodes are polished by this method, the electrodes tend to be broken because even the flat portions contact the abrasive cloth due to the pressure applied to the substrates.

A conventional method well known as laser repair, wherein only projections are removed by using laser beams or the like, is inefficient and lacks mass-productivity since the detection of projections is time-consuming and each projection is treated separately.

DISCLOSURE OF INVENTION

An object of the present invention is to provide an efficient method of producing sheet materials having high surface flatness by polishing the projections protruding from sheet materials, such as plastic films or glass plates, or from the coating or laminated layer provided on the surfaces of the sheet material.

Another object of the present invention is to provide a liquid crystal display device which is produced by using the sheet material produced by the above method and exhibits excellent display properties.

We have studied to solve the above problems and have found that efficient polishing and accurate adjustment of the heights of polished projections can be performed by forming a film of a liquid on the surface of a rod polishing member, which has a surface having polishing capability, and rotating the polishing member while a sheet material is conveyed with its surface contacting the film. Based on these findings, we have made the present invention.

That is, the present invention provides a method of flattening projections on a sheet material having fine projections on a surface thereof, which protrude from a flat portion of the sheet material, which method comprises partially immersing a rod member, which has a surface having a polishing capability, into a liquid, with a portion of the rod member exposed above the surface of the liquid, rotating the rod member so as to form a film of the liquid on the surface of the exposed portion of the rod member, and conveying the sheet material in one direction while contacting a surface of the sheet material with the film, thus polishing the projections.

The present invention also provides a method of manufacturing a sheet material having a flat surface by flattening projections on a sheet material having fine projections protruding from a flat portion of a surface of the sheet material, which method comprises partially immersing a rod member, which has a surface having a polishing capability, into a liquid, with a portion of the rod member exposed above the surface of the liquid, rotating the rod member so as to form a film of the liquid on the surface of the exposed portion of the rod member, and conveying the sheet material having the fine projections in one direction while contacting a surface of the sheet material with the film, thus polishing the projections.

In general, the term "polishing means" both grinding, which means "scraping", and abrasion, which means "wear or burnishing". The term "polishing" used in the present invention means grinding the projections on the surfaces of sheet materials to an almost uniform height. On the other hand, the "polishing" made by the prior arts disclosed in Japanese Patent Application Unexamined Publication Nos. 6-758 and 4-31030 means wear or burnishing since the polished projections have different heights and not only the projections but also the flat portions are polished.

The present invention further provides a liquid crystal display device which has a substrate made of the sheet material made by the method of the present invention.

BEST MODE FOR CARRYING OUT THE INVENTION

Figure 1:
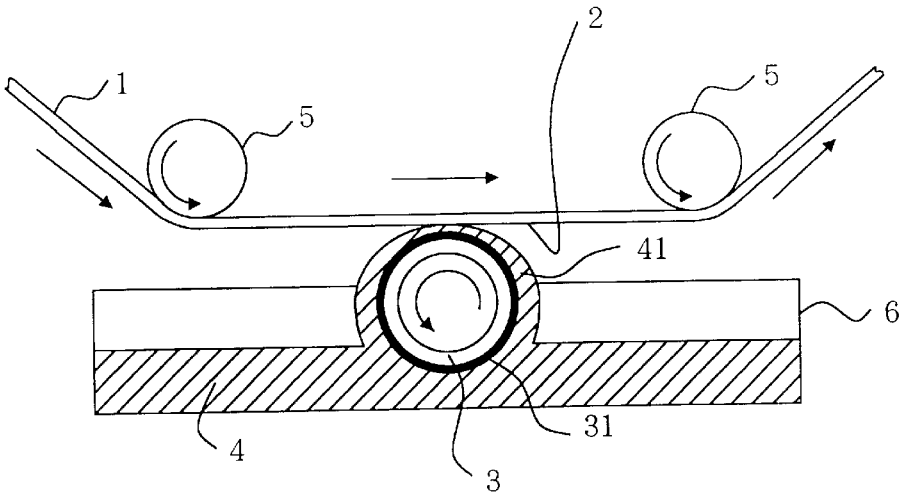
FIG. 1 is an illustrative view showing an embodiment of the method according to the present invention.

Any sheet materials may be used as the sheet material the surface of which is to be flattened by the method of the present invention for flattening the projections on a sheet material or by the method of the present invention for manufacturing a sheet material (hereinafter, these methods will be called the methods of the present invention), and include flexible sheet materials, such as a plastic film or a multilayer film having at least one layer of plastic film, and non-flexible sheet materials, such as a glass plate or a multilayer plate having a layer of a glass plate. The thickness of the sheet material is not limited.

Plastic films or glass plates to be used as the substrates of the display panels of liquid crystal display devices are particularly suitable for methods of the present invention which effect very accurate and high flattening. Examples of the plastic films to be used as the substrates of liquid crystal display devices include uniaxial polyether film, polyethylene film, polypropylene film, polyethersulfone film and polyallylate film. These plastic film substrates may be coated with a layer of an organic substance, such as a gas barrier layer or an undercoating layer, or with a transparent conductive layer, such as ITO, or an insulating layer, such as $SiO_x$ or polyamide, by coating or lamination. Also the glass plates are not limited, and also may be coated with the transparent conductive layer or insulating layer described above by coating or lamination. These substrate materials generally have projections of several $\mu$m to over ten $\mu$m on the surfaces, and are not suitable for liquid crystal display devices which require flat substrates.

The rod member which has a surface having polishing capability may have any form which enables the formation of a film of a liquid having a uniform thickness (as measured in a direction perpendicular to the direction of rotation) on the surface of the rod member by rotating the rod member while partially immersing it in the liquid, and a cylindrical rod member is preferable. The diameter of the rod member is not limited, preferably 20 to 100 mm, more preferably 50 to 100 mm.

The surface of the rod member, which has polishing capability, desirably has a surface roughness of 0.3 $\mu$m or more, preferably 0.3 to 10 $\mu$m, more preferably 0.3 to 5 $\mu$m. The surface roughness of the surface of the rod member means a centerline average roughness (Ra) determined in accordance with JIS B 0601 by taking out a portion of a roughness curve to a length l in a direction of the center line of the roughness curve, plotting the roughness curve, with the center line as the x-axis and the vertical magnification as the y-axis, to express the roughness curve by y=f(x), and calculating Ra by the following equation.

$$Ra=1/l \int_0^l |f(x)|dx$$

The surface of the rod member can be imparted with the polishing capability, for example, by fixing an abrasive to the surface of the rod member, or by forming the surface to have polishing capability, such as projections, on the surface of the rod member.

The shape and material of the abrasive may be selected depending on the material of the sheet material to be polished or on the directed flatness. Examples of the materials of the abrasives suited to polish the panel substrates of liquid crystal display devices include aluminum oxide, chromium oxide, silicon carbide and diamond.

The abrasives can be fixed to the surface of the rod member, for example, by fixing a sheet bearing an abrasive fixed thereto to the surface of the rod member, or by directly coating the surface of the rod member with an abrasive.

Commercial polishing sheets having desired polishing particle sizes may be used as the sheet bearing an abrasive fixed thereto. Alternatively, such sheets may be produced by dispersing an abrasive in an adhesive, and applying the dispersion to a sheet of a film form and then drying. For example, a suitable sheet can be produced by dispersing an abrasive in an epoxy adhesive, gravure-coating a polyester film of about 100 $\mu$m thick with the dispersion, and then heating to dry at a temperature at which the epoxy adhesive cures. The obtained polishing sheet is fixed to the surface of a rod member with an adhesive or the like. Both-sided adhesive tapes may also be used in place of adhesives.

Dipping, which is a known method, is suitable to coat the rod member directly with abrasive. According to the method, a rod member is dipped in an dispersion of an abrasive in an epoxy or other adhesive and then pulled out of the dispersion, to form a thin film of a mixture of the abrasive and the adhesive on the surface of the rod member, followed by drying by heating at a temperature at which the epoxy adhesive cures. It is also possible to use a commercial rod polishing member which is previously coated with an abrasive on its surface.

Examples of the liquids which may be used for forming a film of a liquid on the surface of the rod member having polishing capability are ultra pure water, cutting oil and organic solvents. Examples of cutting oil suitable for the methods of the present invention include silicon oil, sewing machine oil and castor oil, and preferably have a viscosity of 0.2 to 100 cPs, more preferably 0.3 to 10 cPs. Preferred examples of the organic solvents are methanol, isopropyl alcohol and acetone, and have a viscosity of 0.2 to 100 cPs, preferably 0.3 to 10 cPs.

To prevent polishing scraps from adhering to the sheet material, the liquid is preferably changed regularly or continuously before the polishing scraps suspend therein.

The direction of the rotation of the rod member is generally opposite to the direction in which the sheet material is conveyed. The speed of rotation depends on the material of the sheet material, the heights of projections and the material or shape of the abrasive, and is generally 50 rpm or more, preferably 50 to 500 rpm, more preferably 150 to 500 rpm.

To improve the flatness of the surface by minimizing the polishing scores left in the polished portions, the particle size of the abrasive is preferably smaller than the heights of the projections which come in contact with the abrasive as the sheet material is conveyed.

According to the present invention, the surfaces of sheet materials can be flattened with high accuracy without scoring the flat portions since the heights of the polished projections can be controlled by the thickness of the film of a liquid, which is formed on the surface of a rod member having polishing capability by rotating the rod member.

FIG. 1 shows an embodiment of the method of the present invention. In this embodiment, a flexible sheet material 1 is conveyed by two rolls 5 in the uniform direction of the arrow. A cylindrical rod member 3 having a surface 31 having polishing capability is partially immersed in a liquid 4 contained in a container 6, and is rotated in the direction of the arrow so that, over the surface of the liquid 4, a film 41 of the liquid 4 is formed on the surface 31. The sheet material 1 is conveyed in one direction along the two rolls 5, with its surface 2 having projections in contact with the surface of the film 41 of the liquid 4 over the rotating rod member 3.

Figure 2:
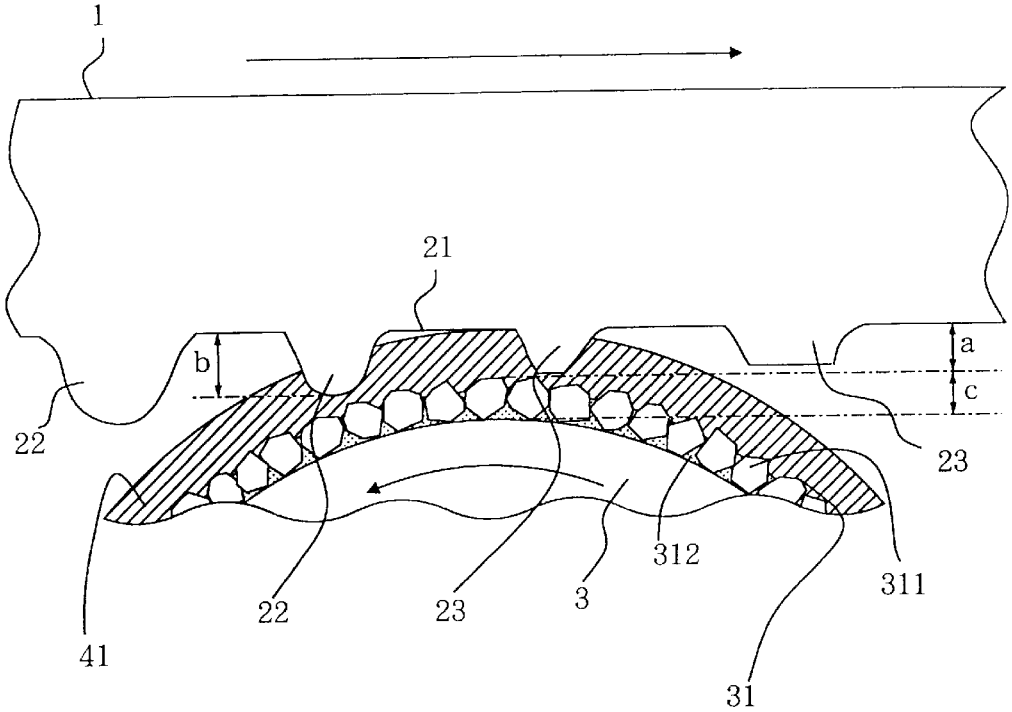
FIG. 2 is a partially enlarged view of FIG. 1.

FIG. 2 is an enlarged view of a portion of FIG. 1 where the sheet material 1 contacts the film 41 of the liquid 4. The rod member 3 has a surface 31 having polishing capability which is formed by fixing an abrasive 311 with an adhesive 312. When the film 41 contacting the flat portions 21 of the sheet material 1 has a thickness of "a" and the projections 22 have heights of "b", only the projections the heights of which satisfy a>b contact the abrasive 311, and are ground to form projections 23 of an approximately uniform height. That is, according to the present invention, the degree of polishing can be controlled by the thickness of the film of liquid. The thinner the film is, the more the degree of polishing increases, increasing the flatness of the surface of the sheet material. The thickness of the film is controlled depending on the desired degree of flatness and the heights of the projections to be ground.

The thickness of the film of a liquid depends on the rotational speed of the rod member and the viscosity of the liquid. Table 1 shows an example of the relationship between the number of rotations of a rod member and the thickness of a film of a liquid, which was obtained by using a rod member produced by forming a layer of an abrasive of 0.5 μm in particle size on the surface of a cylindrical rod of 20 mm in diameter and, as the liquid, an ultra pure water having a viscosity of 0.8 cPs.

TABLE 1

| Number of rotations (rpm) | Thickness (μm) |
|---|---|
| 20 | 0.5 |
| 50 | 0.8 |
| 100 | 1.1 |
| 200 | 1.3 |
| 480 | 1.4 |

The sheet material may be conveyed by any means which can put the sheet material in contact with the film of the liquid covering the surface of the rod member while the sheet material is conveyed at a uniform tension.

For example, a flexible, long sheet material, such as plastic film, can be polished efficiently by using a conveying means which is commonly used in coating apparatuses, such as kiss coaters or gravure coaters, and has members for unwinding and winding the sheet material. To continuously polish many non-flexible sheet materials, such as glass plates, it is desirable to form a conveyer belt into a loop having a portion where the belt moves linearly in one direction over the rod member, and fix the sheet material to the conveyer belt at the portion moving linearly in one direction to polish the sheet material. For example, it is preferable to apply or bond an adhesive or a both-sided adhesive tape to the back of the sheet materials, such as glass plates, to fix the sheet material temporarily to the conveyer belt.

The conveying speed of the sheet material depends on the number of the rotations of the rod member, the kind of the abrasive, the kind of the sheet material, or the like, and is generally 0.1 to 10 m/min, preferably 1 to 5 m/min.

The liquid crystal display device of the present invention contains a substrate made of the sheet material having a surface flattened by the method of the present invention. The liquid crystal display device may have any structure so far as it has a substrate made of the sheet material described above, and generally comprises a pair of electroded substrates, at least one of which is transparent, and a liquid crystal layer interposed between the electroded sides of the substrates.

The sheet materials to be used in the liquid crystal display device of the present invention may be any ones, such as glass or plastics, provided that a transparent sheet material is used as at least one substrate and that electrodes can be formed on the surfaces thereof. Examples of such plastic sheet materials include crystalline polymers, such as uniaxially or biaxially stretched polyethylene terephthalate (PET), non-crystalline polymers, such as polysulfones (PS) and polyethersulfones (PES), polyolefins, such as polyethylene and polypropylene, polyallylates (PAr), polycarbonates (PC) and polyamides, such as nylon. The sheet materials to be used as the substrates are generally 100 μm to 1 mm, preferably 100 μm to 500 μm in thickness.

In the present invention, the materials of the sheet materials forming the two substrates may be identical with or different from each other, and at least one should be a optically transparent sheet material and should be provided with optically transparent or semi-transparent electrodes.

Examples of the transparent or semi-transparent electrodes include tin oxide film, which is called NESA film, indium oxide film, ITO film made of a mixture of indium oxide and tin oxide, evaporation layer of gold or titanium, and other metal or alloy films, such as a thin film of aluminum. The forms of the electrodes are not limited and can be selected depending on the display system or operation system of the liquid crystal display device.

The sheet material to be used as the substrate may be flattened by the methods of the present invention after an electrode layer is formed thereon, or may be provided with an electrode layer after its surface is flattened by the methods of the present invention.

The liquid crystal forming the liquid crystal layer may be any one selected from known liquid crystals, including smectic liquid crystals, nematic liquid crystals, cholesteric liquid crystals and ferroelectric liquid crystals, such as chiral smectic C phase. The liquid crystal layer is not limited in thickness, and when formed of ferroelectric liquid crystals, generally 0.5 to 10 μm, preferably 1 to 3 μm.

Insulating layers may be interposed between the liquid crystal layer and the electrodes, to prevent electric continuations between the electrodes. Also spacers may be arranged in the liquid crystal layer to prevent electric continuations between the electrodes by maintaining a uniform cell gap between the electrodes.

The liquid crystal display device of the present invention may optionally have an orientation film contacting each side of the liquid crystal layer. The orientation film may be an orientation film commonly used in liquid display devices, and various orientation films can be used, for example, a polymer film of a polyimide or polyvinylalcohol rubbed in one direction, or a silicon oxide film formed by oblique evaporation. The liquid crystal display device does not need the orientation film when the liquid crystal is oriented by other methods, such as bending the liquid crystal display device, application of shear stress to the liquid crystal by sliding the upper and lower substrates, or applications of shear stress and voltage.

The present invention will be described in more detail with reference to the following Examples and Comparative examples. The examples, however, are not to be construed to limit the scope of the invention.

EXAMPLE 1

An abrasive film coated with aluminum oxide abrasive particles of 0.5 μm in particle size (IMPERIAL WRAPPING FILM: produced by Sumitomo 3M Co., ltd.) was fixed with a both-sided adhesive tape to the coating roller of 20 mm in diameter of a gravure coater, to produce a rod member which has a surface having polishing capability. The surface of the rod member had a surface roughness of 0.5 μm. A long film substrate, which was a polyethersulfone film (PES: an FST produced by Sumitomo Bakelite Co., Ltd.) bearing ITO transparent electrodes (width: 1 mm, thickness: 0.08 μm) aligned in a stripe form (gap: 0.07 mm, pitch: 1.07 mm), was set on the gravure coater. As shown in FIG. 1, the roller wrapped with the abrasive film was immersed into an ultra pure water (viscosity: 0.8 cPs at room temperature) which was fed into an over-flow container at 200 cc/min. While rotating the roller at 480 rpm, the film substrate was conveyed at 0.6 m/min so that it contacted the film of the ultra pure water on the roller, to carry out polishing. The film of the ultra pure water was 1.4 μm thick.

Before the polishing, the surface of the film substrate had 80 projections of heights of 2 μm or more in an area of 300 mm×600 mm. When observed by a microscope after the polishing, the projections were apparently ground. By height measurements using a scanning laser microscope, it was found that no projections of 2 μm or more were present in the same area and that an original projection of 3.5 μm was ground into a projection of 0.8 μm. All projections which had been 2 μm or more in height before the polishing were ground to have heights of 1 μm or less. This shows that the heights of the projections were reduced to heights less than the thickness (1.4 μm) of the film of the ultra pure water.

The following liquid crystal material was dissolved in toluene (concentration: 25% by weight) and was applied to the electroded surface of the film substrate by using a micro-gravure coater at a coating speed of 2 m/min, to form a 3 μm thick layer of the liquid crystal material.

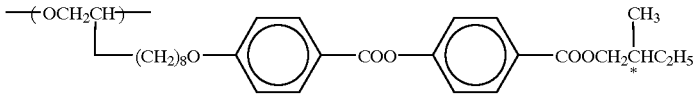

Mn = 3000

Phase transition behavior $$g\ \frac{7}{7}\ SmC^*\ \frac{52}{52}\ SmA\ \frac{83}{79}\ Iso\quad (^\circ\mathrm{C.})$$

(*g*: glass state, *SmC**: chiral smectic *C* phase, *SmA*: smectic *A* phase, *Iso*: isotropic phase)

An ITO-electroded film substrate, which was produced in the same manner as above, was laminated on the liquid crystal layer by using a pair of pressing rolls, and orientation was carried out by bending the whole panel while a direct current voltage of 40 V was applied between the upper and lower substrates at room temperature. When the panel was arranged between crossed polarization plates and driven to make display, no display defects due to the projections on the substrates were observed in an area of 300 mm×600 mm.

The number of display defects is the number of the visible portions where abnormal display occurs. Such display defects were confirmed to be caused by projections higher than the space (3 μm) between the substrates.

EXAMPLE 2

TOREJIN (produced by Teikoku Kagaku Sangyo Co., Ltd.) was dissolved in methanol to form a solution of 10% by weight concentration. 10 g of an aluminum oxide abrasive of 0.3 μm in particle size was added thereto, and stirred. A stainless steel rod of 20 mmϕ was dipped into the liquid, and then pulled up at 0.5 m/min and allowed to stand in an atmosphere of 100° C. for 5 minutes to dry and solidify the liquid. A rod member having polishing capability on its surface was produced by dipping the stainless rod into methanol for 10 seconds, thereby dissolving the surface and expose the abrasive. By an electron microscopic observation, 3 to 4 abrasive particles were observed on the surface of the rod member, and the surface having polishing capability had a surface roughness of 0.3 μm.

A long film substrate of polyethersulfone (PES: an FST produced by Sumitomo Bakelite Co., Ltd.) having a surface coated with an undercoat layer (urethane resin) for improving adhesion to ITO was set on a gravure coater. As shown in FIG. 1, the above-described stainless steel rod coated with the abrasive was immersed into an ultra pure water (viscosity: 0.8 cPs at room temperature) which was fed into an over-flow container at 200 cc/min. While rotating the stainless steel rod at 350 rpm, the film substrate was conveyed at 0.8 m/min so that it contacted the film of the ultra pure water on the stainless steel rod, to carry out polishing. The film of the ultra pure water was 1.0 μm thick.

Before the polishing, the surface of the film had 70 projections of heights of 2 μm or more in an area of 300 mm×600 mm. By height measurements using a scanning laser microscope, it was found that after the polishing, no projections of 2 μm or more were present in the same area and that an original projection of 3.0 μm was ground into a projection of 0.6 μm. All projections which had been 2 μm or more in height before the polishing were ground to have heights of 0.8 μm or less. This shows that the heights of the projections were reduced to heights less than the thickness (1.0 μm) of the film of the ultra pure water.

An ITO transparent conductive material was evaporated onto the polished surface of the film substrate, and a solution of the above liquid crystal material in toluene (concentration: 25% by weight) was applied to the ITO evaporation layer at a coating speed of 2 m/min by using a micro-gravure coater, to form a liquid crystal layer of 3 μm thick. A film substrate, which was polished and provided with an ITO evaporation layer in the same manner as above, was laminated on the liquid crystal layer by using a pair of pressing rolls, and orientation was carried out by bending the whole panel while a direct current voltage of 40 V was applied between the upper and lower substrates at room temperature.

When the panel was arranged between crossed polarization plates and driven to make display, no display defects due to the projections on the substrates were observed in an area of 300 mm×800 mm.

EXAMPLE 3

An abrasive film coated with aluminum oxide abrasive particles of 1.0 μm in particle size (IMPERIAL WRAPPING FILM: produced by Sumitomo Three M Co., ltd.) was fixed with a both-sided adhesive film to the coating roller of 20 mm in diameter of a gravure coater, to form a surface having polishing capability on the coating roller. The surface having polishing capability had a surface roughness of 1.0 μm. A long film substrate, which was a polyethersulfone film (PES: an FST produced by Sumitomo Bakelite Co., Ltd.) was set on the gravure coater. By using a both-sided adhesive tape, a glass substrate of 300 mm×300 mm was fixed to the above film on the side of the film facing the coating roller, between the member for unwinding the film and the polishing portion. In the same manner as in Example 1, the roller was immersed into an ultra pure water (viscosity: 0.65 cPs at 40° C.) which was fed into an over-flow container at 200 cc/min. While rotating the roller at 400 rpm, the film was conveyed at 0.5 m/min so that the surface of the glass substrate contacted the film of the ultra pure water on the roller, to carry out polishing. The film of the ultra pure water was 0.7 μm thick.

Before the polishing, the surface of the glass substrate of 300 mm×300 mm had 10 projections of heights of 2 μm or more. By height measurements using a scanning laser microscope, it was found that after the polishing, no projections of 2 μm or more were present in the same area and that all projections which had been 2 μm or more in height before the polishing were ground to have heights of 0.4 μm or less. Since the film of the ultra pure water was 0.7 μm thick, it is apparent that the heights of the projections were reduced to heights less than the thickness of the film of the ultra pure water, to give a flattened substrate.

COMPARATIVE EXAMPLE 1

A liquid crystal panel was produced in the same manner as in Example 1 except that the ITO-electroded film substrate was not polished. The film substrate which did not polished had 15 projections of heights of 3 μm or more in an area of 300 mm×600 mm. When the liquid crystal panel was driven in the same manner as in Example 1, 30 display defects due to projections were observed in an area of 300 mm×600 mm.

COMPARATIVE EXAMPLE 2

When the projections of heights of 3 μm or more on the unpolished film substrate used in Example 1 were removed by using a laser repair apparatus, the detection of the projections took 6 seconds per projection, and the removal of projections by laser irradiation took around 10 to 20 seconds per projection. That is, a time of about 7 minutes was taken to remove projections of heights of 3 μm or more from one film substrate of 300×600 mm having 15 projections of 3 μm or more in height. In Example 1, polishing was completed in about 1 minute per one film substrate of the same sizes. This shows that the method of the present invention is also excellent in mass-productivity.

COMPARATIVE EXAMPLE 3

By using an apparatus for polishing the filter substrates for liquid crystal panels (produced by Sanshin Co., Ltd.) which employs the technique described in Japanese Patent Application Unexamined Publication No. 6-758, it was tried to grind the projections on the unpolished film substrate used in Example 1. When polishing was carried out while the film substrate was pressed against an abrasive tape at a uniform pressure of 2 kg/m$^2$, a projection of 50 μm in width and 3 μm in height was ground to have a height of 2 μm. However, a projection of 150 μm in width and 3.2 μm in height was barely ground to have a height of 3.0 μm. This shows that when it is tried to control the degree of polishing by pressure, the manner in which a pressure is applied varies depending on the forms of projections, so that the heights of the polished projections cannot be controlled accurately. Also, the scraps in the working atmosphere formed projections on the surface of the film substrate, causing the breaking of the ITO electrodes and the caving of the substrate due to pressure.

As described above, the projections on the surface of the film substrate could not ground surely by the method wherein polishing was carried out while the film substrate was pressed against the abrasive at a uniform pressure.

INDUSTRIAL APPLICABILITY

When a sheet material which has a surface having fine projections is flattened by the methods of the present invention, the projections can be polished accurately to a specific height or less, without scoring the flat portions of the surface of the sheet material. The methods of the present invention, therefore, is particularly suited to flatten sheet materials requiring surfaces thereof highly flattened, such as the substrates for liquid crystal display devices. The methods are also suitable for continuous mass-polishing since the methods can be performed by very simple procedures, which comprise immersing a rod member which has a surface having polishing capability into a liquid, rotating the rod member to form a film of the liquid on its surface and conveying a sheet material while contacting the surface of the sheet material to the film.

The liquid crystal display device of the present invention is free from the display defects due to the projections on the surfaces of substrates, and exhibits excellent display performances.

I claim:

1. A method of flattening projections on a sheet material having fine projections on a surface thereof, which protrude from a flat portion of the sheet material, which method comprises partially immersing a rod member, which has a surface having a polishing capability, into a liquid, with a portion of the rod member exposed above the surface of the liquid, rotating the rod member so as to form a film of the liquid on the surface of the exposed portion of the rod member, and conveying the sheet material in one direction while contacting a surface of the sheet material with the film, thus polishing the projections.

2. The method of claim 1, wherein the surface of the rod member having a polishing capability has a surface roughness of 0.3 μm to 10 μm.

3. The method of claim 2, wherein the sheet material is a plastic film, a multilayer film having at least one layer of a plastic film, a glass plate or a multilayer plate having at least one layer of a glass plate.

4. A liquid crystal display panel which has a substrate made of a sheet material polished by the method of claim 3.

5. The method of claim 2, wherein the surface of the rod member having a polishing capability has a surface roughness of 0.3 to 5 μm.

6. The method of claim 1, wherein the liquid has a viscosity of 0.2 to 100 cPs.

7. The method of claim 6, wherein the sheet material is a plastic film, a multilayer film having at least one layer of a plastic film, a glass plate or a multilayer plate having at least one layer of a glass plate.

8. A liquid crystal display panel which has a substrate made of a sheet material polished by the method of claim 7.

9. The method of claim 1, wherein the sheet material is conveyed in one direction at a conveying speed of 0.1 to 10 m/min.

10. The method of claim 9, wherein the sheet material is a plastic film, a multilayer film having at least one layer of a plastic film, a glass plate or a multilayer plate having at least one layer of a glass plate.

11. A liquid crystal display panel which has a substrate made of a sheet material polished by the method of claim 10.

12. The method of any claim 1, wherein the sheet material is a plastic film, a multilayer film having at least one layer of a plastic film, a glass plate or a multilayer plate having at least one layer of a glass plate.

13. A liquid crystal display panel which has a substrate made of a sheet material polished by the method of claim 12.

14. The method of claim 1, wherein the film of the liquid has a thickness, and wherein the flat portion of the sheet material is spaced from the surface of the rod member having the polishing capability, by the thickness of said film of the liquid.

15. The method of claim 1, wherein the surface of the rod member, having the polishing capability, is made of an abrasive material selected from the group consisting of aluminum oxide, chromium oxide, silicon carbide and diamond.

16. The method of claim 1, wherein the rod member rotates at 50 to 500 rpm.

17. The method of claim 1, wherein the rod member rotates at 150 to 500 rpm.

18. The method of claim 1, wherein the rod member is a cylindrical rod member with a diameter of 20 to 100 mm.

19. The method of claim 1, wherein the rod member is a cylindrical rod member with a diameter of 50 to 100 mm.

20. A method of manufacturing a sheet material having a flat surface by flattening projections on a sheet material having fine projections protruding from a flat portion of a surface of the sheet material, which method comprises partially immersing a rod member, which has a surface having a polishing capability, into a liquid, with a portion of the rod member exposed above the surface of the liquid, rotating the rod member so as to form a film of the liquid on the surface of the exposed portion of the rod member, and conveying the sheet material having the fine projections in one direction while contacting a surface of the sheet material with the film, thus polishing the projections.

21. A liquid crystal display panel which has a substrate made of a sheet material produced by the method of claim 20.

22. The method of claim 20, wherein the surface of the rod member having a polishing capability has a surface roughness of 0.3 to 10 $\mu$m.

23. The method of claim 20, wherein the surface of the rod member having a polishing capability has a surface roughness of 0.3 to 5 $\mu$m.

24. The method of claim 20, wherein the rod member rotates at 50 to 500 rpm.

25. The method of claim 20, wherein the rod member rotates at 150 to 500 rpm.

26. The method of claim 20, wherein the rod member is a cylindrical rod member with a diameter of 20 to 100 mm.

27. The method of claim 20, wherein the rod member is a cylindrical rod member with a diameter of 50 to 100 mm.

28. The method of claim 20, wherein the film of the liquid has a thickness, and wherein the flat portion of the sheet material is spaced from the surface of the rod member having the polishing capability, by the thickness of said film of the liquid.

* * * * *